United States Patent [19]

Slywka

[11] 4,091,457

[45] May 23, 1978

[54] MIXER FOR VISCOUS MATERIALS

[75] Inventor: Michael Slywka, Parma, Ohio

[73] Assignee: The Gibson-Homans Company, Cleveland, Ohio

[21] Appl. No.: 799,384

[22] Filed: May 23, 1977

[51] Int. Cl.[2] ..... B01F 7/18

[52] U.S. Cl. ..... 366/304; 366/309; 366/325; 366/327

[58] Field of Search ..... 259/107, 108, 7, 8, 259/23, 24, 43, 44, 66, 67, 122

[56] References Cited

U.S. PATENT DOCUMENTS

| | | | |
|---|---|---|---|
| 78,925 | 1/1868 | Cassard | 259/7 |
| 229,726 | 7/1880 | McAnespey | 259/107 |
| 2,268,475 | 12/1941 | Darby | 259/8 X |
| 3,333,827 | 8/1967 | Lodige et al. | 259/8 |
| 3,551,114 | 12/1970 | Hellewell | 259/107 X |

FOREIGN PATENT DOCUMENTS

| | | | |
|---|---|---|---|
| 470,013 | 12/1950 | Canada | 259/8 |
| 76,857 | 9/1948 | Czechoslovakia | 259/107 |

*Primary Examiner*—Philip R. Coe
*Attorney, Agent, or Firm*—McNenny, Pearne, Gordon, Gail, Dickinson & Schiller

[57] ABSTRACT

A mixing apparatus is disclosed comprising a vessel, a central shaft adapted to be rotationally driven and a stirrer arranged for stirring operation upon rotation of the shaft. The stirrer includes upwardly and downwardly extending interleaved blade assemblies arranged for relative rotation and a cross blade transversely extending from the shaft in a sawtooth pattern at the lower level of the blade assemblies. The downwardly extending blade assembly is stationary, and it is carried by an upper support member fixed to the vessel. The upwardly extending blade assembly is carried by a lower support arm fixed to the shaft for rotation therewith. The cross blade extends along the lower support arm, and it comprises a plurality of elements each connecting and extending between a pair of adjacent upwardly extending blades or the shaft and an upwardly extending adjacent blade.

19 Claims, 4 Drawing Figures

MIXER FOR VISCOUS MATERIALS

BACKGROUND OF THE INVENTION AND PRIOR ART

The present invention generally relates to the processing of highly viscous materials and, more particularly, to an apparatus having a novel and improved stirrer arrangement which integrates a vertical interleaved blade structure with a lateral cross blade structure to provide uniform mixing throughout the vessel and improved processing efficiency.

The highly viscous materials of concern herein generally develop a viscosity in the range of from about 7,500 to about 1,000,000 SSU and greater in the course of processing. The specific nature of the material and its ultimate application are only of concern to the extent that its processing involves the intimate mixing of highly viscous materials as contemplated herein. The highly viscous materials of interest are exemplified by roof coating compositions having an asphalt base and containing an asbestos fiber as well as a glass fiber constituent. In preparing such coating compositions, the components of the composition are typically charged into the mixing apparatus in a timed sequence and particular order, and chemical reactions as well as physical changes may occur during the mixing process. In the case of roof coating compositions, the separate component charges include asphalts, spirits, asbestos fibers, glass fibers and putty fillers. Accordingly, the initial charge to the vessel may include solid and resinous components of widely varying densities as well as liquid components having extremely diverse viscosities and equally diverse dispersing and/or solvency characteristics relative to the solid and resinous components.

For purposes of production efficiency, it is desirable to optimize the vessel or batch capacity to a maximum size with minimization of the processing time. The consistency of the resulting mixed material including uniform blend and/or reaction characteristics and the achievement of uniform viscosity are guidelines in the optimization of the mixing. In many instances, temperature control throughout the mass being mixed is necessary, and it comprises an important processing parameter which also requires a maximum movement of the mass within the apparatus. In the processing of all such highly viscous materials, an important parameter is the apparatus's capability to contend with the required physical manipulation of the mass since relatively high structural loads are imposed by such highly viscous materials. It is also desirable to establish complete mixing action throughout the vessel or batch since the momentum flow of such viscous materials is limited. These optimization considerations have not been heretofore satisfactorily resolved in the prior use of vertically interleaved blade mixers in the processing of highly viscous materials.

SUMMARY OF THE INVENTION

The present invention is directed to a mixing apparatus comprising a vessel having a vertically extending, centrally located shaft adapted to be rotationally driven and a stirrer arranged within the vessel for mixing operation upon rotation of the shaft. The stirrer includes upwardly and downwardly extending interleaved blade assemblies arranged for relative rotational movement and a cross blade laterally extending in a sawtooth pattern from the vertical shaft at the lower level of the blade assemblies. The lower portions of the interleaved blade assemblies extend within the sawtooth pattern defined by the cross blade. The interleaved blade assemblies and cross blade are arranged to provide complementary flow mixing patterns substantially throughout the vessel of material being processed and optimization of the mixing process.

In the illustrated embodiment, the vessel is provided with a cylindrical sidewall and a substantially flat bottom wall. The stirrer includes a fixed support member mounted to the top of the vessel, and the downwardly depending blade assembly comprises a plurality of blades depending from the fixed support at spaced intervals along a diameter of the vessel in a planar array. The stirrer also includes a lower support arm diametrically extending within the vessel from the vertical shaft adjacent the bottom wall. The upwardly extending blade assembly comprises a plurality of blades extending upwardly from the lower support arm in a planar array and in an interleaved arrangement with the downwardly extending blades so as to pass through one another with clearance upon relative rotational movement. The stirrer is bilaterally asymmetrical relative to the shaft so as to provide additional variation in the concentric flow patterns and the shearing of the material. The cross blade member extends along the lower support arm and it includes a plurality of triangulated truss elements each connecting adjacent blades of the upwardly extending blade assembly or the vertical shaft and an adjacent blade of the assembly. The cross blade member defines a plurality of upwardly opening V-shapes through which the lower portions of the downwardly extending blades sweep during mixing.

In the operation of the apparatus, the interleaved blade assemblies establish concentric flow patterns in the material being mixed and impose a shearing action upon the material. The cross blade provides upward and downward flows of the material as it passes through the highly viscous mass. The cross blade has a wedge shape cross-section having a pitch and sufficient frontal area to shear the viscous material upon rotation and to establish upward and downward flows of the material into the concentric flow patterns provided by the interleaved blade assemblies. Accordingly, the interleaved blade assemblies and cross blade impose multiple shearing actions upon the viscous material and cooperate to provide complementary flow patterns of the material while providing a mixing action throughout substantially the entire volume of the vessel and the mass of the material being processed.

In contrast with prior art apparatuses, the subject mixing apparatus has been found to enable increased vessel or batch sizes and reduced processing times with improved consistency of the resulting processed or mixed material. Further, the present apparatus efficiently disburses high density component agglomerations which tend to accumulate adjacent the bottom of prior interleaved blade mixers. It is believed that these improvements are a result of the combined shearing actions and complementary flow patterns established by the apparatus while providing stirring or mixing movement throughout the volume of the vessel and material being processed. The cross blade arrangement has been found to simultaneously provide significant improvements in the degree of physical movement or mixing-flow of the material being processed and structural reinforcement of the apparatus so as to result in corresponding improvements in the capability of the apparatus to physically manipulate the highly viscous material. Accordingly, the subject apparatus is particularly useful in the processing of highly viscous materials including systems wherein component charges of significantly varying viscosity, density and relative mixing characteristics are involved.

BRIEF DESCRIPTIONS OF THE DRAWINGS

DETAILED DESCRIPTION OF THE DRAWINGS

Figure 1:
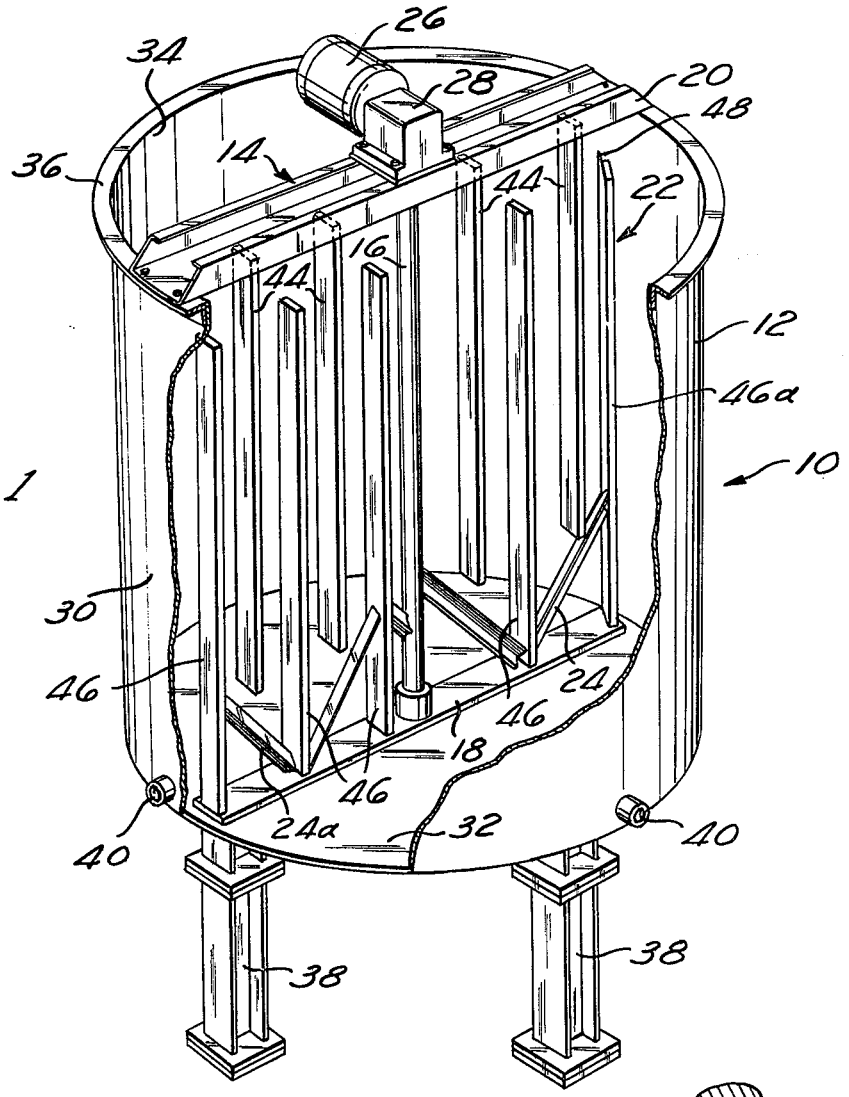
FIG. 1 is a perspective view of a mixing apparatus in accordance with the present invention with parts broken away for purposes of illustrating the stirrer.

Referring to FIG. 1, a mixing apparatus 10 including a vessel 12, a stirrer 14 and a vertically extending, centrally disposed shaft 16 is shown. The stirrer 14 includes a lower support arm 18 and an upper support member 20 having the shaft 16 extending therebetween. The stirrer 14 also includes a vertically oriented interleaved blade assembly 22 and a cross arm or blade member 24. The vertical shaft 16 is arranged to be rotated by a motor 26 operating through a right angle, reducing gear box 28.

The vessel 12 has a generally cylindrical sidewall 30, a substantially flat bottom wall 32 and an open top 34 which is fitted with a flange 36 for purposes of reinforcement. The vessel 12 is conveniently supported on beam members 38, and it is provided with a number of lower drain taps 40 for removal of the processed mass or material.

The upper support member 20 is fixed to the flange 36 and includes a bearing collar 41 (FIG. 3) for supporting the upper end of the shaft 16. The lower end of the shaft 16 extends through the bottom wall 32 of the vessel 12, and it is received in a lower bearing support member 42 secured to the outside surface of the bottom wall 32. The lower support arm 18 is rotationally fixed to the shaft 16.

The interleaved blade assembly 22 includes a plurality of blades 44 extending downwardly from the support member 20. There are a total of four blades 44 disposed along the diameter of vessel 12, two blades being located on each side of the shaft 16, in a substantially symmetrical pattern. The blades 44 are generally of a flat, paddle-like configuration with a rectangular cross-section. The broad faces of the blades 44 are disposed at right angles to a plane passing through a diameter of the vessel 12 and bisecting the broad faces of the blades 44.

Figure 4:
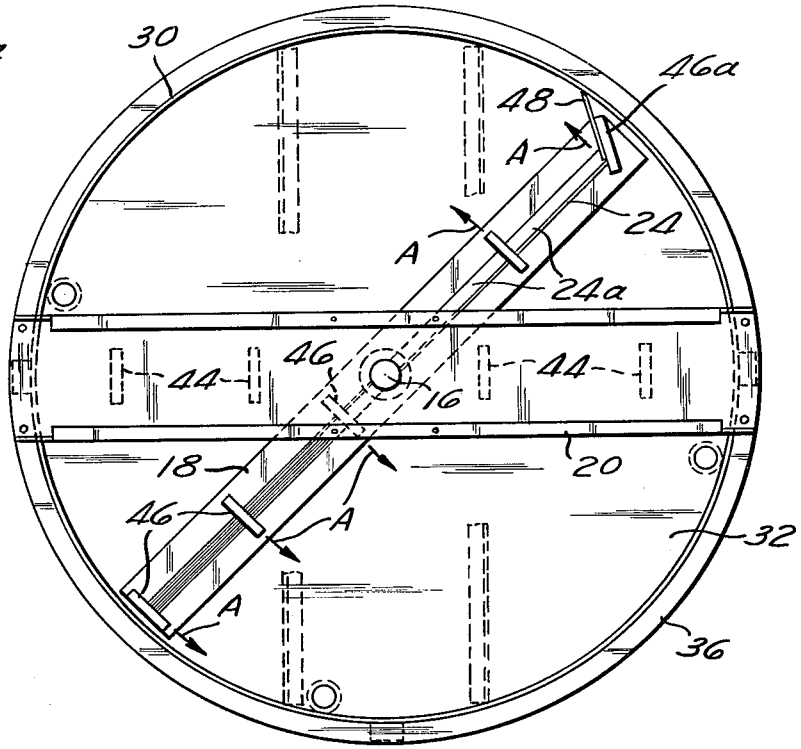
FIG. 4 is a plan view of the mixing apparatus, the direction of the view being indicated by the line 4—4 in FIG. 3 and the stirrer being shown in a rotated position for purposes of illustration.
Figure 3:
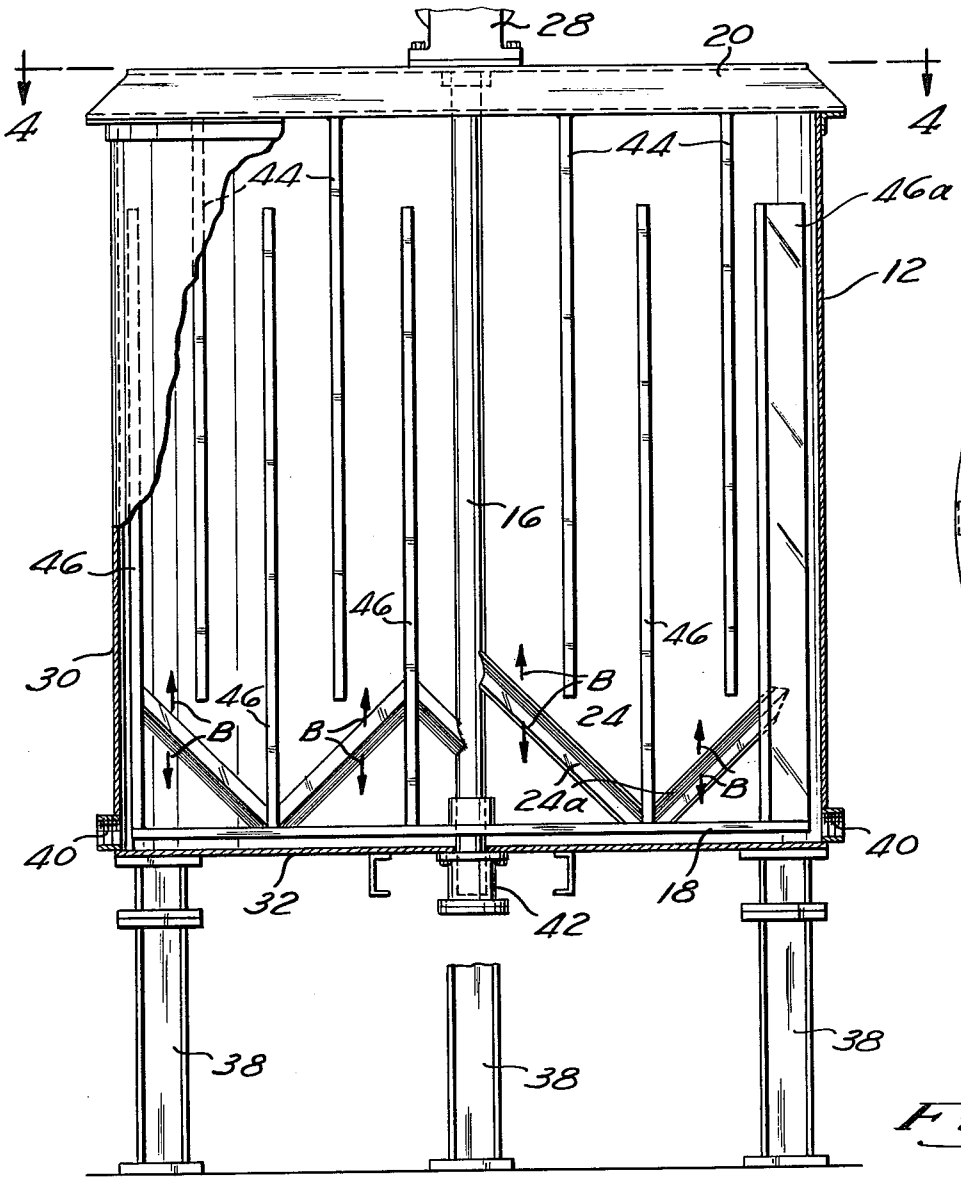
FIG. 3 is a side elevational view of the apparatus with a portion of the vessel wall broken away for purposes of illustration.

The interleaved blade assembly 22 also includes a plurality of blades 46 extending upwardly from the lower support arm 18. There are a total of five blades 46, including scraper blade **46*a*, arranged in an asymmetrical pattern along the support arm 18 and a diameter of vessel 12 as best shown in FIGS. 3 and 4. The blades 46 also have a generally flat configuration of rectangular cross-section with the broad faces of the blades being disposed at right angles to a diameter plane of the vessel 12 as noted above except for the radially outward scraper blade 46*a* which has its face disposed at an intersecting angle relative to the wall 30 for purposes of conveniently mounting a scraper blade 48 for contact with the wall 30. The scraper blade 46*a* is located on the lateral side of the support arm 18 having the fewer number of blades in order to tend to balance the torque loading of the stirrer 14**.

The cross arm or blade member 24 transversely extends along the lower support arm 18 in a sawtooth or V-shape pattern in a vertical plane passing through a diameter of the vessel 12. The cross blade 24 is comprised of a plurality of elements or segments **24*a* each rigidly connecting and extending between adjacent blades 46 or a shaft adjacent blade 46 and the shaft 16. The elements 24*a* are also connected to the lower support arm 18 at points of intersection therewith, and they provide the upwardly extending blades 46 with a truss structure. The elements 24*a* are rigidly secured in position by any convenient means, such as welding. Each of the elements 24*a* is disposed at about a 45° angle with respect to the bottom wall 32 and the shaft 16, and adjacent elements are inclined in opposite directions so as to form the sawtooth pattern. The elements 24*a* extending between the shaft adjacent blade 46, on each side of the shaft, and the shaft 16 are preferably connected to the shaft 16 at locations remote from the support arm 18** in order to maximize reinforcement at this region of high stress and to avoid an undue excess of stirrer blade structure in this region which may tend to accumulate or entrap the material being processed.

In the illustrated embodiment, two upwardly opening V shapes are defined by the blade 24, and portions of the downwardly extending blades 44 as well as the blades 46 extend within the openings of the V shapes. The vertical integration of the interleaved blade assembly 22 and the transversely extending blade 24 results in improved mixing efficiency and substantially increased mixer capacities as described below in greater detail.

Figure 2:
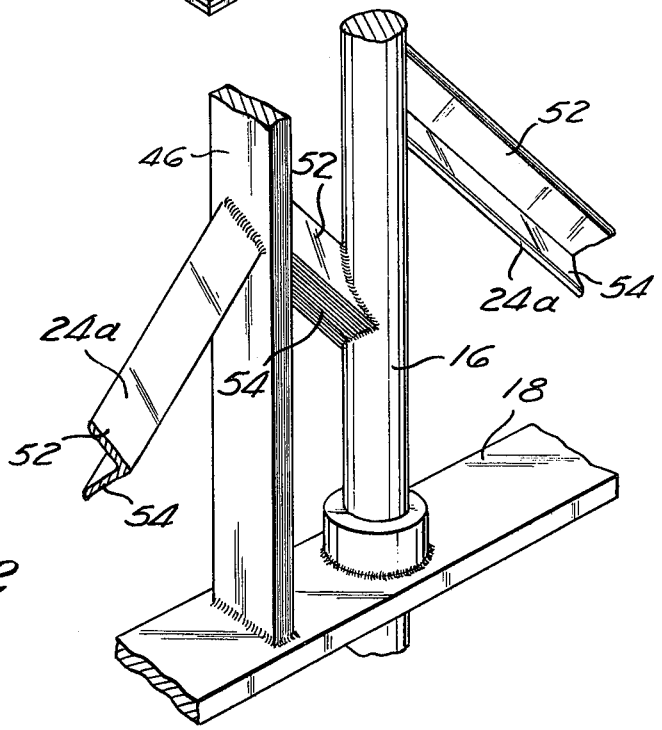
FIG. 2 is a fragmentary perspective view on an enlarged scale of a portion of the stirrer.

Each of the elements **24*a* of the cross blade 24 tapers to a wedge shape in the direction of rotation and includes an upwardly flow directing surface 52 and a downward flow directing surface 54 as best shown in FIG. 2. The flow surfaces 52 and 54 preferably intersect at an angle of about 45° in order to assure a shearing of the highly viscous material. Further, the intersecting flow surfaces 52 and 54 of the elements 24*a* are designed to provide the blade 24 with a pitch and frontal area which assure vertical flow patterns in the highly viscous material being processed and which particularly avoid a mere looping of the material about the elements 24*a*** without establishing directional flow patterns.

As indicated above, the mixing apparatus 10 provides two directionally distinct flow patterns in the mass of the material being processed. Each of the rotating blades 46 advances material in the direction of rotation in a concentric flow pattern as generally indicated by the arrows A in FIG. 4 and through the stationary blades 44 with a shearing action. Assuming a 0° rotation start point, the asymmetrical array of blades 46 serves to vary the location and number of concentric flow patterns in the mass being processed after each 180° of rotation of the shaft 16. Similarly, the shearing coaction between the asymmetrical array of blades 46 and the stationary blades 44 varies with each 180° of rotation of the shaft 16 to provide further variations in the concentric mixing action.

The cross blade 24 establishes vertical flow patterns as generally indicated by the arrows B in FIG. 3 in the material being processed to assure a uniform blending and composition through the height of the material being processed in the vessel 12. The combined concentric and vertical flow patterns have been found particularly advantageous in high viscosity material processing where large variations in densities of components are likely to be encountered with corresponding tendencies for the high density components to settle and in some instances to agglomerate. The blade 24 serves to break up and disperse the high density components, which in many high viscosity applications assume a paste like consistency, with a shearing action and to direct such components into the concentric flow patterns of the interleaved blade assembly 22 for further shearing and mixing action. The downwardly directed flow patterns provided by the cross blade 24 serve to flush material from the regions adjacent the bottom of the vessel 12.

The mixing apparatus 10 achieves improved mix consistency in the processing of highly viscous materials and optimization of the vessel or batch size by integrating distinct concentric and vertical flow patterns with a structural arrangement that has been found to enable the vessel or batch capacity to be increased by factors in the range of two to four depending upon the maximum viscosity developed during processing without corresponding increases in processing or mixing time. An increased batch size is particularly advantageous in a process or system wherein certain of the components require preliminary processing with definite mix times or reaction times which cannot be substantially varied. In comparison with a prior art mixing apparatus having a vertically interleaved blade assembly but not employing a transverse cross arm or blade member, the mixing apparatus 10 has been found to enable the vessel or batch size to be increased from 1,000 gallons to 2,000 gallons while only requiring about a 15% increase in the total processing time.

What is claimed is:

1. An apparatus for mixing highly viscous materials comprising a vessel having a generally vertically extending, centrally located shaft adapted to be rotationally driven and a stirrer arranged within said vessel for stirring operation upon rotation of said shaft, said stirrer including upwardly and downwardly extending blade assemblies arranged for relative rotational movement and cross arm means transversely extending within said vessel from said shaft at the lower level of said blade assemblies, each of said blade assemblies comprising an array of spaced blades disposed in a substantially planar arrangement with blades located on each side of said shaft, one of said arrays of blades being rotationally fixed and the other of said arrays of blades being operably connected to said shaft for rotational movement therewith, said arrays of blades being arranged to pass through one another with clearance upon relative rotational movement, said cross arm means comprising a cross blade member rigidly connecting and extending between the adjacent blades of said other of said arrays of blades in a sawtooth pattern with the adjacent blades on each side of said shaft being fixed to the shaft by said cross blade member extending in said sawtooth pattern.

2. An apparatus as set forth in claim 1 wherein said other of said arrays of blades comprises said upwardly extending blade assembly, and said stirrer includes a lower support arm radially extending from said shaft for supporting said upwardly extending blade assembly and said cross blade member.

3. An apparatus as set forth in claim 1 wherein said sawtooth pattern of said cross blade member includes at least one upwardly opening V shape through which a lower portion of at least one blade of said downwardly extending blade assembly sweeps upon relative rotation of said blade assemblies.

4. An apparatus as set forth in claim 1 wherein the blades of one of said assemblies of blades are bilaterally asymmetrical relative to said shaft.

5. An apparatus as set forth in claim 1 wherein one of said assemblies of blades includes a greater number of blades on one side of said shaft than on the other side of said shaft.

6. An apparatus as set forth in claim 1 wherein said other of said arrays of blades including a greater number of blades on one side of said shaft and a scraper blade on the other side of said shaft arranged to engage a sidewall of said vessel.

7. An apparatus as set forth in claim 1 wherein said cross blade member tapers to a wedge shape cross-section in the direction of rotation.

8. An apparatus as set forth in claim 1 wherein said cross blade includes upwardly and downwardly directing flow surfaces.

9. An apparatus for mixing highly viscous materials comprising a generally cylindrical shape vessel having a substantially vertically oriented, centrally located shaft adapted to be rotationally driven and a stirrer arranged within said vessel for stirring operation upon rotation of said shaft, said stirrer including upwardly and downwardly extending interleaved blade assemblies arranged for relative rotational movement upon rotation of said shaft and a cross blade member transversely extending within said vessel from said shaft at the lower level of said interleaved blade assemblies, each of said blade assemblies comprising an array of spaced blades disposed in a substantially vertical plane passing through said shaft with blades located on each side of the shaft, said arrays of blades being arranged to pass through one another with clearance upon relative rotational movement, one of said arrays of blades being rotationally fixed and the other of said arrays of blades being carried on a support arm diametrically extending from said shaft for rotation therewith, said cross blade member comprising a plurality of triangulated truss elements each connecting and extending between a pair of adjacent blades of said other of said arrays of blades or the shaft and an adjacent blade.

10. An apparatus as set forth in claim 9 wherein said truss elements connecting said shaft and said adjacent blades are connected to said shaft at locations remote from said support arm.

11. An apparatus as set forth in claim 9 wherein said other of said arrays of blades is bilaterally asymmetrical with respect to said shaft.

12. An apparatus as set forth in claim 9 wherein said cross blade member tapers to a wedge shape in the direction of rotation.

13. An apparatus as set forth in claim 9 wherein an uppermost point of said truss elements upon rotation defines a plane located above the lowermost extent of said one of said arrays of blades.

14. An apparatus for mixing highly viscous materials comprising a vessel having a generally vertically extending, centrally located shaft adapted to be rotationally driven and a stirrer arranged within said vessel for stirring operation upon rotation of said shaft, said stirrer including upwardly and downwardly extending arrays of blades arranged for relative rotational movement upon rotation of said shaft and a cross blade member transversely extending within said vessel from said shaft at the lower level of said arrays of blades, each of said arrays of blades comprising a plurality of laterally spaced blades located on each side of said shaft with one of said arrays of blades being fixed against rotation and the other of said arrays of blades being operably connected to said shaft for rotation therewith to provide the relative rotational movement, said arrays of blades being arranged to pass through one another with clearance upon relative rotational movement, said cross blade member being associated with said other of said arrays of blades and comprising a plurality of wedge-shaped elements each connecting and extending between a pair of adjacent blades or the shaft and an adjacent blade in a generally vertically oriented sawtooth pattern including openings through which lower portions of said one of said arrays of blades sweep with clearance upon relative rotational movement.

15. An apparatus as set forth in claim 14 wherein said stirrer includes a lower support arm transversely extending from said shaft and said other of said arrays of blades is carried on said support arm.

16. An apparatus as set forth in claim 15 wherein said cross blade member extends along said support arm and is connected thereto.

17. An apparatus as set forth in claim 14 wherein said wedge-shaped elements are inclined at about 45° angles with respect to said shaft in said sawtooth pattern.

18. An apparatus as set forth in claim 14 wherein said one of said arrays of blades is said downwardly extending array of blades and said stirrer includes an upper support member fixed to said vessel and having said plurality of laterally spaced blades depending downwardly therefrom.

19. An apparatus for mixing highly viscous materials comprising a vessel having a generally vertically extending, centrally located shaft adapted to be rotationally driven and a stirrer arranged within said vessel for stirring movement upon rotation of said shaft, said stirrer including upwardly and downwardly extending interleaved blade assemblies arranged in a bilaterally asymmetrical pattern with respect to said shaft and cross arm means transversely extending within said vessel from said vertical shaft at the lower level of said interleaved blade assemblies, said downwardly extending blade assembly being fixed against rotational movement and said upwardly extending blade assembly being carried by a lower support arm operably connected to said vertical shaft for rotational movement therewith to establish concentric flow patterns in the highly viscous material, said cross arm means comprising a plurality of triangulated truss elements having upwardly and downwardly flow directing surfaces and extending along said lower support arm in a sawtooth pattern, each of said elements connecting adjacent blades of said upwardly extending blade assembly or a shaft-adjacent blade and said shaft, each of said blade assemblies including blade portions extending within said sawtooth pattern defined by said cross arm means.

* * * * *